US009605898B2

(12) United States Patent
Boland et al.

(10) Patent No.: US 9,605,898 B2
(45) Date of Patent: Mar. 28, 2017

(54) DRUM TEMPERATURE CONTROL FOR A RADIANT DRYER OF A PRINTING SYSTEM

(71) Applicants: Stuart J. Boland, Denver, CO (US); Sean K. Fitzsimons, Thornton, CO (US); Scott Johnson, Erie, CO (US); William Edward Manchester, Erie, CO (US); Casey E. Walker, Boulder, CO (US)

(72) Inventors: Stuart J. Boland, Denver, CO (US); Sean K. Fitzsimons, Thornton, CO (US); Scott Johnson, Erie, CO (US); William Edward Manchester, Erie, CO (US); Casey E. Walker, Boulder, CO (US)

(73) Assignee: Ricoh Company, Ltd., Tokyo (JP)

( * ) Notice: Subject to any disclaimer, the term of this patent is extended or adjusted under 35 U.S.C. 154(b) by 614 days.

(21) Appl. No.: 13/788,758

(22) Filed: Mar. 7, 2013

(65) Prior Publication Data

US 2014/0250712 A1 Sep. 11, 2014

(51) Int. Cl.

| | |
|---|---|
| ***F26B 3/34*** | (2006.01) |
| ***F26B 3/28*** | (2006.01) |
| ***B41J 11/00*** | (2006.01) |
| ***B41J 29/377*** | (2006.01) |

(52) U.S. Cl.

CPC ..... *F26B 3/283* (2013.01); *B41J 11/002* (2013.01); *B41J 29/377* (2013.01)

(58) Field of Classification Search

CPC ..... B41J 29/377; B41J 2/1408; F26B 3/283; G03G 15/2017

USPC ..... 34/267, 266; 347/18, 104, 212; 399/69, 399/33, 67, 320; 430/117.5, 430/124.1–124.54; 101/488, 487

See application file for complete search history.

(56) References Cited

U.S. PATENT DOCUMENTS

| | | | |
|---|---|---|---|
| 5,043,741 | A | 8/1991 | Spehrley, Jr. |
| 5,168,289 | A | 12/1992 | Katakabe et al. |
| 5,281,442 | A | 1/1994 | Fulton et al. |

(Continued)

FOREIGN PATENT DOCUMENTS

| | | | |
|---|---|---|---|
| DE | 102004052820 | A1 | 5/2006 |
| DE | 202010002859 | U1 | 5/2010 |

(Continued)

*Primary Examiner* — Kenneth Rinehart
*Assistant Examiner* — John McCormack
(74) *Attorney, Agent, or Firm* — Duft Bornsen & Fettig LLP

(57) ABSTRACT

Systems and methods provide enhanced radiant drying capabilities for a printing system utilizing temperature control of a thermally conductive drum. One embodiment comprises a radiant dryer and a control system. The radiant dryer includes a thermally conductive drum and a plurality of radiant energy sources disposed along an outside surface of the drum. The energy sources dry a colorant applied to a print medium in contact with the drum. The radiant dryer further includes a cooling system that applies a coolant to the drum to remove heat from the drum. The control system measures the temperature of the drum, determines a difference between the temperature of the drum and a target temperature, and directs the cooling system to vary an application of the coolant to the drum based on the difference to maintain the drum at the target temperature.

11 Claims, 4 Drawing Sheets

(56) References Cited

U.S. PATENT DOCUMENTS 5,455,604 A * 10/1995 Adams ..... B41J 11/002 101/409
5,502,788 A 3/1996 Platsch
5,537,925 A 7/1996 Secor et al.
5,614,933 A * 3/1997 Hindman ..... B41J 2/005 347/103
5,634,402 A * 6/1997 Rudd et al. ..... 101/424.1
6,854,842 B2 2/2005 Martin et al.
6,876,823 B2 4/2005 Kojima et al.
6,983,696 B2 1/2006 Koch et al.
7,092,667 B1 * 8/2006 Landa et al. ..... 399/330
7,167,193 B2 1/2007 Goetzke et al.
7,860,418 B2 * 12/2010 VanKouwenberg . G03G 15/167 399/307
7,966,743 B2 6/2011 Piatt et al.
8,328,321 B2 * 12/2012 Tsuzawa ..... B41J 11/0015 347/101
2007/0153074 A1 7/2007 Anderson et al.
2007/0166071 A1 * 7/2007 Shima ..... 399/94
2009/0225149 A1 9/2009 Osawa et al.
2011/0069104 A1 3/2011 Tsuzawa
2011/0205282 A1 * 8/2011 Houjou ..... 347/16
2011/0205321 A1 * 8/2011 Kobayashi ..... B41J 2/155 347/102
2012/0050372 A1 3/2012 Yamaguchi
2012/0062638 A1 3/2012 Toya
2013/0127962 A1 * 5/2013 Yoda ..... B41J 13/0009 347/102
2013/0265359 A1 * 10/2013 Sugaya ..... B41J 11/002 347/16

FOREIGN PATENT DOCUMENTS

EP 0676300 A2 10/1995
EP 1356933 A1 10/2003
EP 2650132 A 10/2013
WO 2007068878 A 6/2007
WO 2013076906 A 5/2013

* cited by examiner

DRUM TEMPERATURE CONTROL FOR A RADIANT DRYER OF A PRINTING SYSTEM

FIELD OF THE INVENTION

The invention relates to the field of printing systems, and in particular, to radiant drying systems.

BACKGROUND

Businesses or other entities having a need for volume printing typically purchase a production printer. A production printer is a high-speed printer used for volume printing, such as 100 pages per minute or more. The production printers are typically continuous-form printers that print on paper or some other printable medium that is stored on large rolls.

A production printer typically includes a localized print controller that controls the overall operation of the printing system, a print engine (sometimes referred to as an "imaging engine" or as a "marking engine"), and a dryer. The print engine includes one or more printhead assemblies, with each assembly including a printhead controller and a printhead (or array of printheads). An individual printhead includes multiple tiny nozzles (e.g., 360 nozzles per printhead depending on resolution) that are operable to discharge colorants as controlled by the printhead controller. The printhead array is formed from multiple printheads that are spaced in series along a particular width so that printing may occur across the width of the medium. The dryer is used to heat the medium to affix the colorant to the medium.

In dryers that apply a great deal of heat over a short period of time, it remains a problem to ensure that the medium is properly dried. Too much heat can cause the medium to char or burn. At the same time, too little heat can result in the colorant on the medium remaining wet, resulting in smearing or offsetting that reduces the print quality of jobs. Further, print jobs that specify high colorant loadings for the medium may be difficult to dry without applying high radiant power to the medium. However, utilizing higher powers for radiant drying may cause rapid and uncontrolled heating of colorants that absorb radiant energy at a high rate.

SUMMARY

Embodiments described herein provide enhanced radiant drying capabilities for a printing system utilizing temperature control of a thermally conductive drum. The temperature controlled drum is in contact with a print media during radiant drying of the media, and generates a high dissipative heat flux for cooling colorants applied to the media. This allows for a higher power radiant drying process to occur without scorching or burning the media.

One embodiment is a radiant dryer and a control system. The radiant dryer includes a thermally conductive drum, a plurality of radiant energy sources, and a cooling system. The energy sources are disposed along an outside surface of the drum and are operable to dry a colorant applied to a print medium in contact with the drum. The cooling system is operable to apply a coolant to the drum to remove heat from the drum. The control system is operable to measure a temperature of the drum, to determine a difference between the temperature of the drum and a target temperature, and to direct the cooling system to vary an application of the coolant to the drum based on the difference to maintain the drum at the target temperature.

Another embodiment is a method to provide enhanced radiant drying capabilities for a printing system utilizing temperature control of a thermally conductive drum. The method comprises drying a colorant applied to a print medium in contact with a thermally conductive drum utilizing a plurality of radiant energy sources that are disposed along an outside surface of the drum. The method further comprises applying a coolant to the drum to remove heat from the drum, and measuring the temperature of the drum. The method further comprises determining a difference between the temperature of the drum and a target temperature, and varying an application of the coolant to the drum based on the difference to maintain the drum at the target temperature.

Another embodiment is a non-transitory computer readable medium embodying programmed instructions executable by a processor. The instructions are operable to direct the processor to dry a colorant applied to a print medium in contact with a thermally conductive drum utilizing a plurality of radiant energy sources that are disposed along an outside surface of the drum. The instructions are further operable to direct the processor to apply a coolant to the drum to remove heat from the drum, and to measure a temperature of the drum. The instructions are further operable to direct the processor to determine a difference between the temperature of the drum and a target temperature, and to vary an application of the coolant to the drum based on the difference to maintain the drum at the target temperature.

Other exemplary embodiments may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
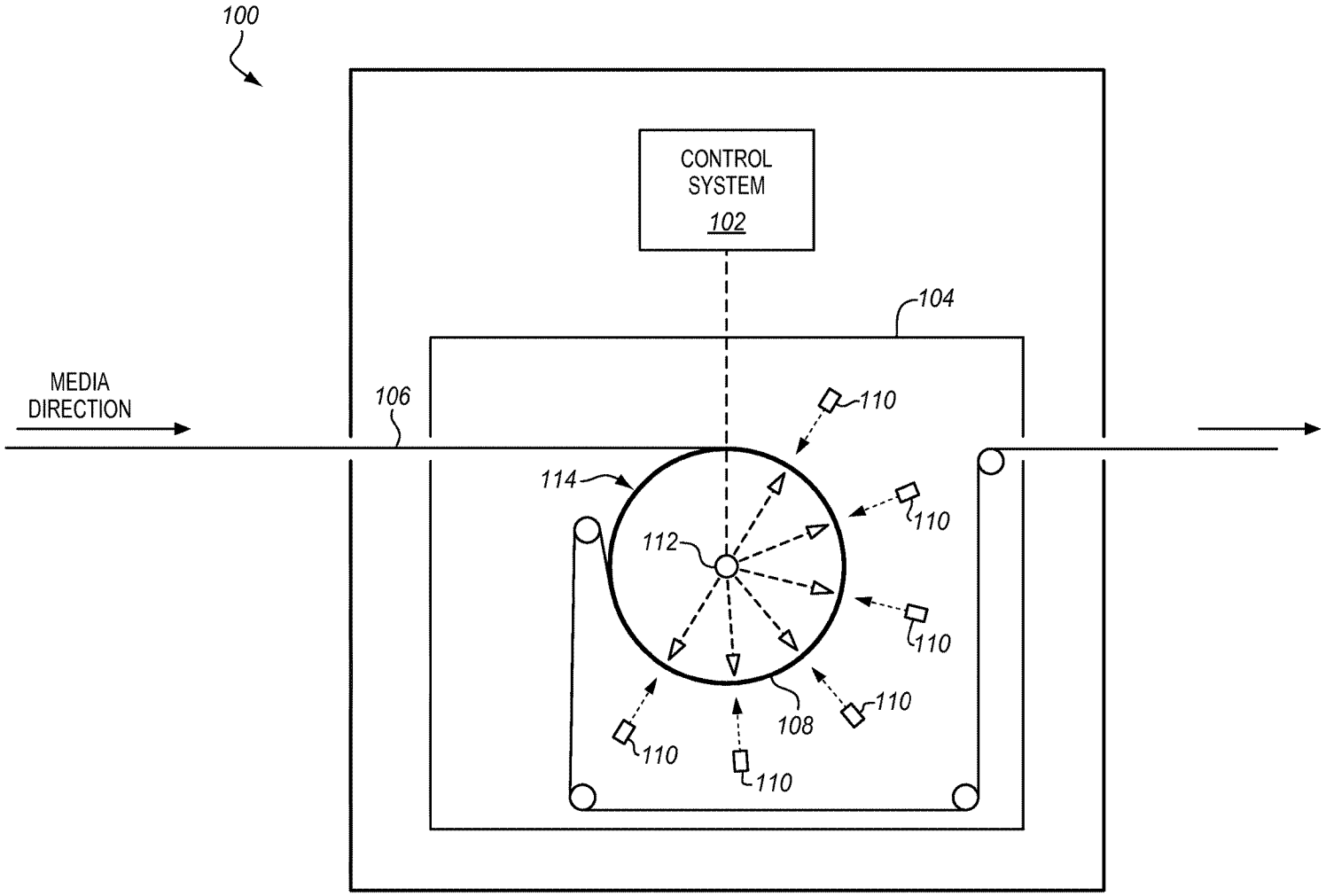
FIG. 1 is a block diagram of a printing system in an exemplary embodiment.

FIG. 1 is a block diagram of a printing system 100 in an exemplary embodiment. In this embodiment, printing system 100 includes a control system 102 and a radiant dryer 104. Radiant dryer 104 includes a thermally conductive drum 108, a plurality of radiant energy sources 110, and a cooling system 112. A web of print media 106 traverses a media path through printing system 100 in the direction indicated by the arrow in FIG. 1. During the printing process, media 106 is marked with a colorant (e.g., by a print engine, not shown in FIG. 1), and enters radiant dryer 104. Media 106 wraps around drum 108 and has heat applied by energy sources 110 to dry the colorant. During the drying process, heat absorbed by media 106 and the colorants thermally conducts to drum 108 and causes drum 108 to absorb energy. Cooling system 112 utilizes a coolant (not shown) to remove heat from drum 108. Some examples of the coolant may include liquids (e.g., water, glycol), a gas (e.g., air), or some combination thereof.

One problem with printing systems is that high power radiant drying can cause charring or burning of a web of print media if the marked portions of the web heat up excessively. Further, the amount of radiant energy that can be applied during the drying process is limited by the rate that energy can be removed from the colorant as the colorant dries. Often, radiant dryers include a number of fans to promote air flow and to reduce the peak temperatures that arise during drying of the colorants. However, air flow has limits as to how fast energy can be removed from the colorants. For instance, as the carrier fluids in the colorants evaporate, air flow may provide much less capability in removing energy from the now-dry colorant, which continues to absorb radiant energy during the drying process. Thus, hot spots arise on the web, which can cause the web to char, burn, or catch fire.

In this embodiment, printing system 100 varies a coolant applied by cooling system 112 to maintain a temperature of the thermally conductive drum 108 close to or at a target temperature. This provides a thermal path for the energy absorbed by the colorants during a radiant drying process to be absorbed by drum 108. For example, control system 102 may maintain the target temperature of drum 108 within a range of about 60 degrees Celsius and 150 degrees Celsius, which is significantly lower than the peak temperatures reached by some colorants during the radiant drying process (e.g., Key black colorant may reach nearly 250 degrees Celsius during radiant drying). Controlling the temperature of drum 108 allows for a rapid transfer of energy absorbed by the colorant into drum 108 during the drying process. The energy absorbed by drum 108 from media 106 and/or the colorant is then removed by the coolant. This rapid transfer of energy, or high dissipative heat flux, allows for substantially higher powered radiant drying to occur. For instance, while a typical radiant drying system may only apply 1-5KW of power to radiant emitters to dry a web, radiant dryer 104 may apply upwards of 20-40KW of power to energy sources 110 to dry media 106. This allows for a higher loading of colorant on media 106 to be successfully dried. Further, because media 106 may be tightly drawn against drum 108 to facilitate a more uniform heat transfer between media 106 and drum 108, the dimensions of media 106 may be more stable during the drying process. This reduces the potential for curling or wrinkling of media 106 during drying, which is undesirable.

Broadly speaking, control system 102 in this embodiment comprises any system, component, or device that is operable to maintain the temperature of drum 108 close to or at target temperature (e.g., by controlling an application of coolant to drum 108 based on drum 108 temperature). Thus, the implementation of how printing system 100 performs this functionality varies widely and is generally a matter of design choice.

Consider an example whereby a print operator is tasked with printing a job at printing system 100, which provides enhanced drying capabilities. The print operator may specifically select printing system 100 based on the combination of colorants and print media specified in a job ticket for the print job, especially in cases where the job specifies a high colorant loading on media 106. The print operator initiates printing of the job, which causes media 106 to traverse along a media path through printing system 100 in the direction indicated by the arrow in FIG. 1. Media 106, now wet with colorant, enters radiant dryer 104 and wraps around drum 108.

Figure 2:
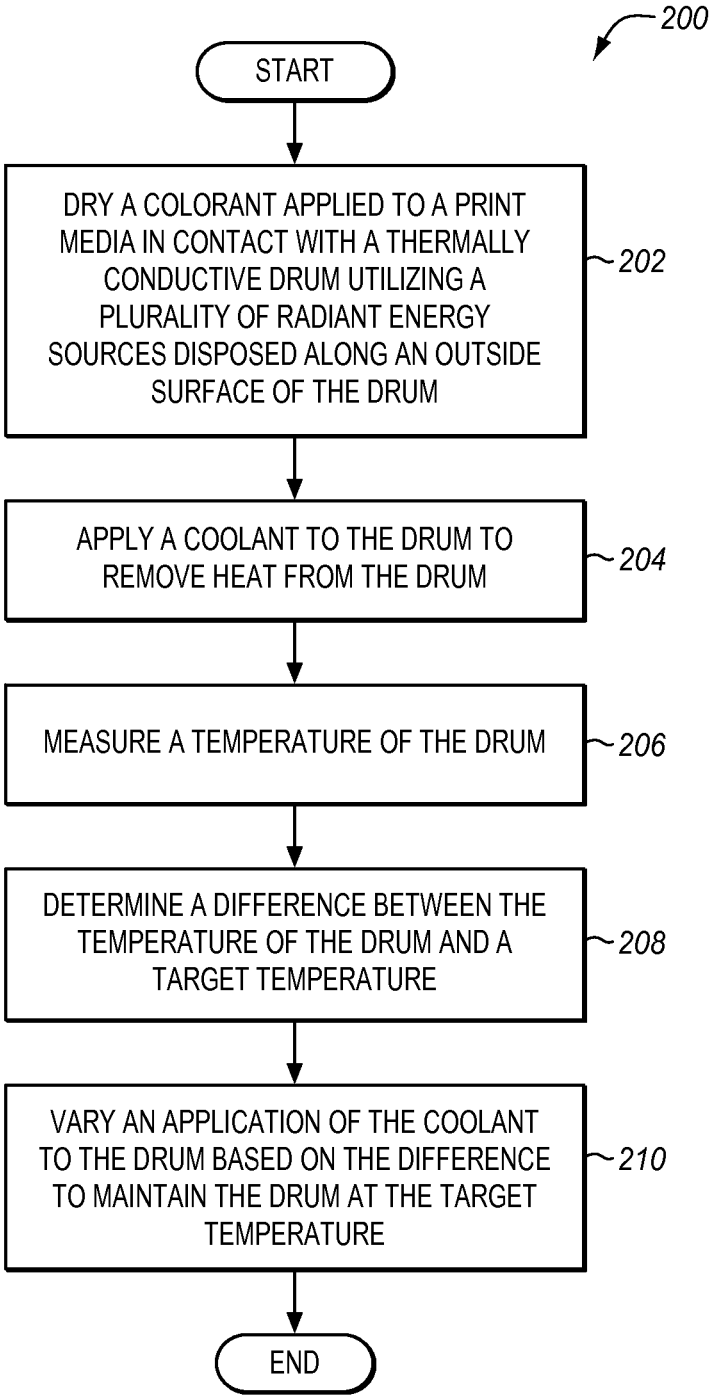
FIG. 2 is a flowchart illustrating a method to provide enhanced radiant drying capabilities for a printing system utilizing temperature control of a thermally conductive drum in an exemplary embodiment.

FIG. 2 illustrates a method 200 of providing enhanced radiant drying capabilities for a printing system utilizing temperature control of a thermally conductive drum in an exemplary embodiment. The steps of method 200 are described with reference to printing system 100 of FIG. 1, but those skilled in the art will appreciate that method 200 may be performed in other systems. The steps of the flowchart(s) described herein are not all inclusive and may include other steps not shown. The steps described herein may also be performed in an alternative order.

In step 202, radiant dryer 104 dries a colorant applied to media 106 in contact with drum 108 utilizing energy sources 110 that are disposed along an outside surface 114 of drum 108. Energy sources 110 may be Infrared (IR) sources, near-IR sources, etc. IR energy is absorbed by the colorant applied to media 106, and the colorant heats up and begins to dry.

In step 204, control system 102 directs cooling system 112 to apply a coolant to drum 108 to remove heat from drum 108. In some embodiments, cooling system 112 may utilize a plurality of jets within drum 108 to direct the coolant onto an interior surface of drum 108. In other embodiments, cooling system 112 may utilize channels or other voids within drum 108 and proximate to an outside surface 114 of drum 108 to remove heat from drum 108. Therefore, drum 108 may be solid or hollow as a matter of design choice.

In step 206, control system 102 measures a temperature of drum 108. Control system 102 may measure the temperature utilizing a non-contact sensor having a view of outside surface 114 of drum 108, a sensor in contact with outside surface 114 of drum, a sensor embedded within drum 108, etc. For embodiments whereby drum 108 is hollow, control system 102 may measure the temperature of drum 108 utilizing a non-contact sensor having a view of the inside surface (not shown in FIG. 1) of drum 108, a sensor in contact with the inside surface of drum 108, a sensor embedded between the inside surface and outside surface 114 of drum 108, etc.

In step 208, control system 102 determines a difference between the temperature of drum 108 and a target temperature. Generally, selecting the target temperature is a trade-off from the temperature being too high or the temperature being too low. If the target temperature is too low, then wrinkling of media 106 may occur. If the target temperature is too high, then the heat transfer rate from the colorant(s) on media 106 to drum 108 is reduced.

In step 210, control system 102 directs cooling system 112 to vary an application of the coolant to drum 108 based on the temperature difference to maintain drum 108 at the target temperature. For instance, if the measured temperature of drum 108 is above the target temperature, then control system 102 may direct cooling system 112 to apply more coolant to drum 108 to remove heat from drum 108 at a faster rate, thus cooling drum 108. In like manner, if the measured temperature of drum 108 is below the target temperature, then control system 102 may direct cooling system 112 to apply less coolant to drum 108 to remove heat from drum 108 at a slower rate, thus allowing drum 108 to heat up. This allows control system 102 to maintain the temperature of drum 108 at the target temperature and/or within a threshold amount of the target temperature.

As discussed previously, cooling system 112, in some embodiments, may employ a plurality of jets that direct the coolant onto an interior surface of drum 108 to remove heat from drum 108. For instance, if the jets direct air towards an interior surface of drum 108, then control system 102 may direct cooling system 112 to vary the velocity, mass flow rate, on time for the jets, etc., of the air applied onto the interior surface of drum 108 to maintain drum 108 at and/or within a threshold amount of the target temperature. Further, the interior surface of drum 108 may include a feature to increase the surface area and to increase the rate of heat transfer from drum 108. Some examples of the feature include fins, a surface treatment to increase the roughness of the interior surface, etc.

Also discussed previously, control system 102 in some embodiments may utilize channels, voids, or other types of coolant transport mechanisms within drum 108 to remove heat from drum 108. For instance, if water, glycol, or some other type of liquid is transported through the channels within drum 108, then control system 102 may direct cooling system 112 to vary the velocity, mass flow rate, etc., of the liquid through the channel(s) to maintain drum 108 at and/or within a threshold amount of the target temperature.

The thermally conductive properties of drum 108 along with the temperature control of drum 108 allows for a high dissipative heat flux to exist from media 106 and/or the colorants applied to media 106 into drum 108. This reduces the variations in temperatures and the peak temperature across media 106, and allows for higher power radiant drying to occur for media 106 without incurring the additional risks of charring, burning, fires, etc. Further, this improves the printing process by allowing for more rapid drying of print media 106, allowing for higher printing speeds, and/or allowing for successful drying of higher colorant loads applied to media 106.

In some embodiments, cooling is applied to drum 108 at locations that are nearby, coincident, proximate to, etc., the areas on outside surface 114 of drum 108 that receive high heat flux from energy sources 110. For instance, if drum 108 includes coolant channels or voids, then cooling system 112 may drive the coolant along channels that are proximate to a relatively hotter area on outside surface 114 of drum 108. Or, if drum 108 is hollow for instance, then cooling system 112 may direct or spray the coolant onto a region on the inside surface of drum 108 that is approximately opposite to a relatively hotter area on outside surface 114. This allows for a controlled cooling of drum 108 to occur on areas of outside surface 114 of drum 108 where the external heat flux is high. This also reduces temperature variations across outside surface 114 of drum 108 that may occur if cooling is applied substantially uniformly across drum 108 without regard to how external heat is applied to drum 108. This and other aspects of controlled cooling will be discussed in more detail with regard to FIG. 3.

Figure 3:
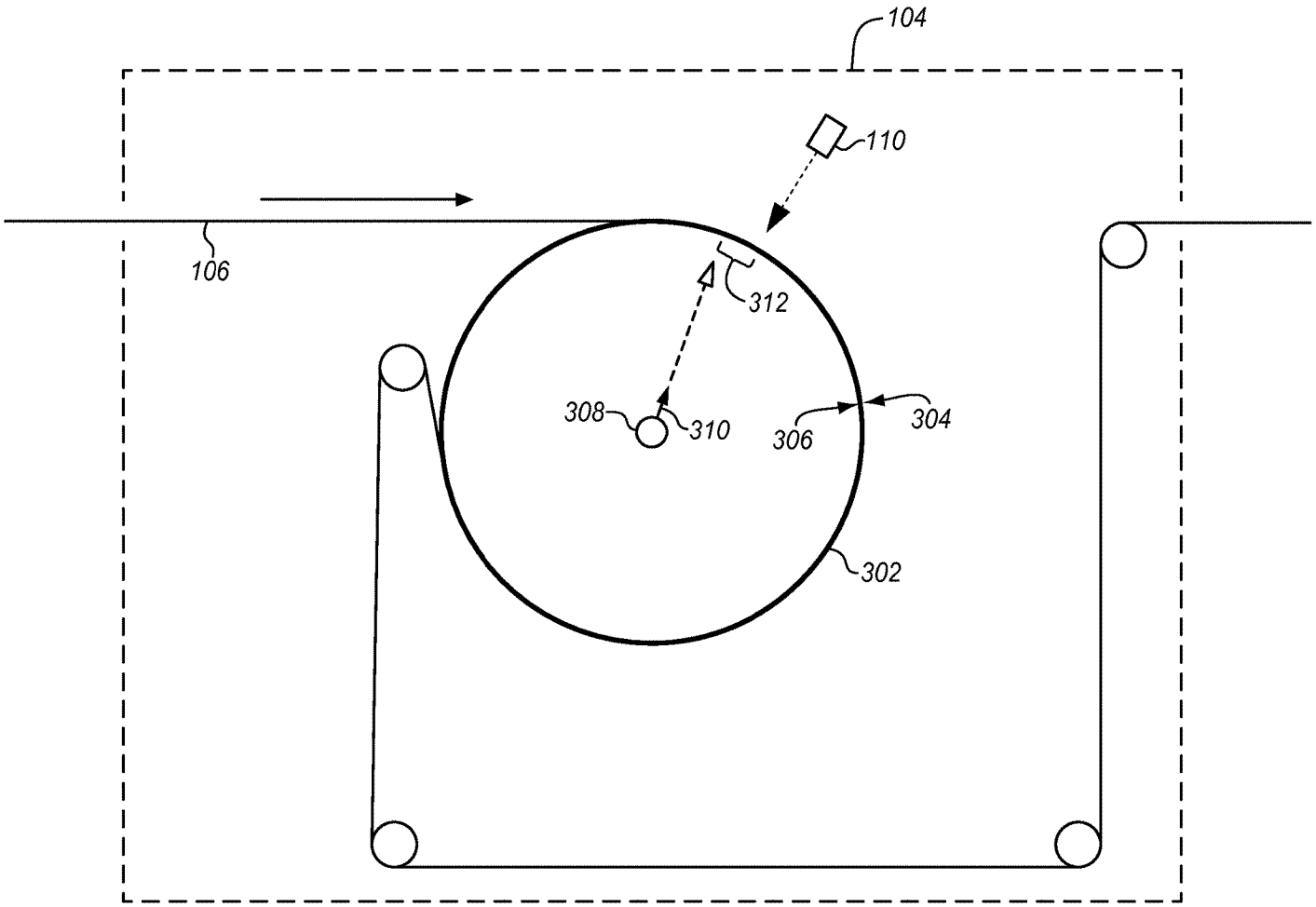
FIG. 3 is a block diagram of a portion of the printing system of FIG. 1 in another exemplary embodiment.

FIG. 3 illustrates a block diagram of a portion of printing system 100 in an exemplary embodiment. In this embodiment, radiant dryer 104 includes a hollow drum 302. Drum 302 includes an outside surface 304 and an inside surface 306. Outside surface 304 is closer to one or more energy sources 110, and inside surface 306 is closer to a cooling system 308. In this embodiment cooling system 308 includes one or more nozzles 310 that direct air toward a region on inside surface 306 of drum 108 that is substantially opposite to areas on outside surface 304 of drum 302 that receive high heat flux. For instance, energy source 110 may be proximate to or direct radiant energy at, a particular area on outside surface 304 of drum 302. Thus, nozzle 310 may direct air onto a region of inside surface 306 that is opposite the area receiving the majority of energy from energy source 110.

Although only one combination of nozzle 310 and source 110 is illustrated in FIG. 3 for purposes of discussion, one skilled in the art will recognize that cooling system 308 may provide any number of nozzle(s) 310 and source 110 combinations as a matter of design choice.

By directing air via nozzle 310 at a particular region on inside surface 306 of drum 302, cooling system 308 may provide more directed cooling at locations around drum 302 that receive high external heat flux. This reduces the possibility of large variations in temperature across outside surface 304 of drum 302, which improves the drying performance of radiant dryer 104.

However, in some embodiments it may be desirable to direct the air onto inside surface 306 of drum 108 based on an offset 312 to the region. Directing the air based on offset 312 allows, in essence, "pre-cooling" of a portion of drum 302 as the portion rotates into the region of high external heat flux generated by energy source 110. In FIG. 3, drum 302 in this embodiment rotates clockwise, as indicate by the direction of media 106 travel. Thus, offset 312 changes where air directed by nozzle 310 impinges inside surface 306 in a direction that is opposite the rotation (i.e., counter-clockwise). This allows for areas on outside surface 304 of drum 302 to be pre-cooled prior to the areas being carried by the rotation into the high heat flux generated by energy source 110.

Offset 312 may be selected based on a variety of factors, such as the thermal characteristics of drum 302, the speed of media 106, the heat flux generated by energy source 110, the heat flux received by a corresponding area on outside surface 304 of drum 108, etc. If the thermal conductivity of drum 302 is low, then offset 312 may be increased to allow more time for heat transfer from outside surface 304 of drum 302 to inside surface 306 of drum 308 to occur. If the speed of media 106 changes, then the angular velocity of drum 302 changes. This modifies how long an area on drum 108 is exposed to cooling prior to the area rotating into proximity of energy source 110. For instance, if the speed of media 106 increases, the offset 312 may increase. If the heat flux generated by energy source 110 is high, then offset 312 may be increased to further reduce the local temperature of an area on outside surface 304 of drum 302 before the area rotates into the high heat flux generated by energy source 110.

Providing targeted cooling to drum 302 improves the dissipative heat flux capability of drum 302 by providing localized cooling to areas of drum 302 that immediately precede a high external heat flux input to drum 302. Further, this targeted cooling allows for other areas of drum 302 that are away from energy sources 110 to maintain their temperatures. This allows drum 302 to additionally provide drying to media 106 based on the characteristics found in drum drying systems.

Figure 4:
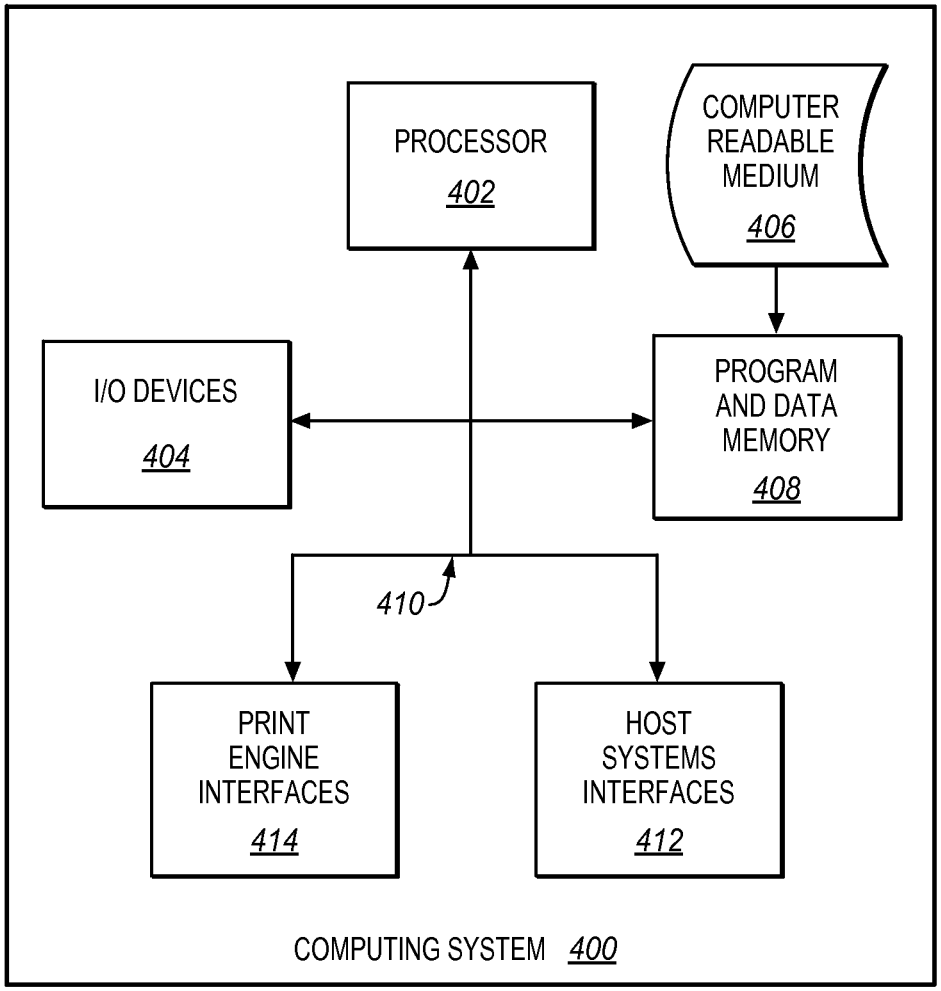
FIG. 4 illustrates a processing system operable to execute a computer readable medium embodying programmed instructions to perform desired functions in an exemplary embodiment.

The invention can take the form of an entirely hardware embodiment, an entirely software embodiment or an embodiment containing both hardware and software elements. In one embodiment, the invention is implemented in software, which includes but is not limited to firmware, resident software, microcode, etc. FIG. 4 illustrates a computing system 400 in which a computer readable medium may provide instructions for performing the method of FIG. 2 in an exemplary embodiment.

Furthermore, the invention can take the form of a computer program product accessible from a computer-usable or computer-readable medium 406 providing program code for use by or in connection with a computer or any instruction execution system. For the purposes of this description, a computer-usable or computer readable medium 406 can be any apparatus that can contain, store, communicate, or transport the program for use by or in connection with the instruction execution system, apparatus, or device.

The medium 406 can be an electronic, magnetic, optical, electromagnetic, infrared, or semiconductor system (or apparatus or device) or a propagation medium. Examples of a computer-readable medium 406 include a semiconductor or solid state memory, magnetic tape, a removable computer diskette, a random access memory (RAM), a read-only memory (ROM), a rigid magnetic disk and an optical disk. Current examples of optical disks include compact disk—read only memory (CD-ROM), compact disk—read/write (CD-R/W) and DVD.

A data processing system suitable for storing and/or executing program code will include one or more processors 402 coupled directly or indirectly to memory 408 through a system bus 410. The memory 408 can include local memory employed during actual execution of the program code, bulk storage, and cache memories which provide temporary storage of at least some program code in order to reduce the number of times code is retrieved from bulk storage during execution.

Input/output or I/O devices 404 (including but not limited to keyboards, displays, pointing devices, etc.) can be coupled to the system either directly or through intervening I/O controllers.

Network adapters may also be coupled to the system to enable the data processing system to become coupled to other data processing systems, such a through host systems interfaces 412, or remote printers or storage devices through intervening private or public networks. Modems, cable modem and Ethernet cards are just a few of the currently available types of network adapters. System 400 further includes print engine interfaces 414.

Although specific embodiments were described herein, the scope of the invention is not limited to those specific embodiments. The scope of the invention is defined by the following claims and any equivalents thereof.

We claim:

1. A non-transitory computer readable medium embodying programmed instructions executable by a processor, the instructions operable to direct the processor to:

dry a colorant applied to a print medium in contact with a portion of an outside surface of a thermally conductive drum utilizing a plurality of radiant energy sources that are disposed across from the portion of the outside surface of the drum;

apply a coolant to an interior surface of the drum utilizing a plurality of cooling jets to remove heat from the drum, wherein the cooling jets direct the coolant onto regions of the interior surface of the drum that are substantially opposite to areas on the outside surface that receive a peak heat flux from the energy sources;

measure a temperature of the drum;

determine a difference between the temperature of the drum and a target temperature; and vary an application of the coolant to the drum based on the difference to maintain the drum at the target temperature.

2. The medium of claim 1 wherein:

instructions to apply the coolant to the drum further comprise instructions to:

direct the coolant at an offset to one of the regions, wherein the offset is based on at least one parameter selected from a thermal characteristic of the drum, a speed of the print medium, and a heat flux received for a corresponding area on the outside surface of the drum.

3. The medium of claim 1 wherein:

the target temperature of the drum is between about 60 degrees Celsius and 150 degrees Celsius.

4. A method comprising:

drying a colorant applied to a print medium in contact with a portion of an outside surface of a thermally conductive drum utilizing a plurality of radiant energy sources that are disposed across from the portion of the outside surface of the drum;

applying a coolant to an interior surface of the drum utilizing a plurality of cooling jets to remove heat from the drum, wherein the cooling jets direct the coolant onto regions of the interior surface of the drum that are substantially opposite to areas on the outside surface that receive a peak heat flux from the energy sources;

measuring a temperature of the drum;

determining a difference between the temperature of the drum and a target temperature; and varying an application of the coolant to the drum based on the difference to maintain the drum at the target temperature.

5. The method of claim 4 wherein:

applying the coolant to the drum further comprises:

directing the coolant at an offset to one of the regions, wherein the offset is based on at least one parameter selected from a thermal characteristic of the drum, a speed of the print medium, and a heat flux received for a corresponding area on the outside surface of the drum.

6. The method of claim 4 wherein:

the target temperature of the drum is between 60 degrees Celsius and 150 degrees Celsius.

7. An apparatus comprising:

a radiant dryer including:

a thermally conductive drum operable to contact a print medium along a portion of an outside surface of the drum;

a plurality of radiant energy sources disposed across from the portion of the outside surface of the drum that are operable to dry a colorant applied to the print medium; and a cooling system that includes a plurality of cooling jets that are operable to apply a coolant to an interior surface of the drum to remove heat from the drum, wherein the cooling jets are operable to direct the coolant onto regions of the interior surface of the drum that are substantially opposite to areas on the outside surface that receive a peak heat flux from the energy sources; and a control system operable to measure a temperature of the drum, to determine a difference between the temperature of the drum and a target temperature, and to direct the cooling system to vary an application of the coolant to the drum based on the difference to maintain the temperature of the drum at the target temperature.

8. The apparatus of claim 7 wherein:

the inside surface of the drum includes a feature to increase a surface area of the inside surface.

9. The apparatus of claim 8 wherein:

the feature is at least one element selected from a fin affixed to the inside surface and a roughness of the inside surface.

10. The apparatus of claim 7 wherein:

at least one of the cooling jets is operable to direct the coolant at an offset to one of the regions, wherein the offset is based on at least one parameter selected from a thermal characteristic of the drum, a speed of the print medium, and a heat flux received for a corresponding area on the outside surface of the drum.

11. The apparatus of claim 7 wherein:

the target temperature of the drum is between 60 degrees Celsius and 150 degrees Celsius.

* * * * *